United States Patent [19]

Midorikawa

[11] Patent Number: 4,540,300

[45] Date of Patent: Sep. 10, 1985

[54] RETRACTABLE CAPLESS MARKING PEN

[75] Inventor: Yoshio Midorikawa, Tokyo, Japan

[73] Assignees: Toyo Polymer Co., Ltd., Tokyo; Kotobuki & Co., Ltd., Kyoto, both of Japan

[21] Appl. No.: 583,306

[22] Filed: Feb. 24, 1984

[30] Foreign Application Priority Data

Feb. 25, 1983 [JP] Japan ..... 58-30465

[51] Int. Cl.[3] ..... B43K 9/00

[52] U.S. Cl. ..... 401/107; 401/108

[58] Field of Search ..... 401/107, 108

[56] References Cited

U.S. PATENT DOCUMENTS 3,525,573 8/1970 Fend ..... 401/108

3,945,734 3/1976 Woodbridge ..... 401/108 X

FOREIGN PATENT DOCUMENTS 1561814 4/1970 Fed. Rep. of Germany ..... 401/107

1424491 12/1965 France ..... 401/107

*Primary Examiner*—Steven A. Bratlie

*Attorney, Agent, or Firm*—Sherman & Shalloway

[57] ABSTRACT

A retractable capless marking pen using an oil ink or an aqueous ink, having a retractable writing member consisting of a small diameter portion and a large diameter portion, and having a constitution capable of preventing the evaporation of the ink by storing the writing head of the writing member hermetically within a sealed elastic cylinder. The constitution comprises a fixed pressing protrusion provided within the sheath, an elastic cylinder enclosing part of the small diameter portion of the writing member, an elastic pressing member having a slanting surface adapted to engage the pressing protrusion and adapted to squeeze the open end of the elastic cylinder as the slanting surface engages the pressing protrusion when the writing member is moved toward the retracted position so that the writing head of the writing member is stored hermetically within the elastic cylinder between the closed front end of the elastic cylinder and the rear end thereof and is sealed by sealing means after the writing head of the writing member has been retracted fully into the sheath.

2 Claims, 2 Drawing Figures

RETRACTABLE CAPLESS MARKING PEN

BACKGROUND OF THE INVENTION

The present invention relates to a projecting capless marking pen.

Various marking pens using an aqueous ink or an oil ink, which are designated commonly as a marking pen or a writing pen, have been developed. Those conventional marking pens are provided with a cap to prevent the evaporation of the ink contained therein through the pen. Those marking pens have problems in that capping and uncapping is troublesome and in that the ink will be exhausted if the marking pen is left uncapped.

Accordingly, it is an object of the present invention to provide a retractable capless marking pen of a new construction employing a pen projecting mechanism and requiring no cap for preventing the evaporation of the ink.

SUMMARY OF THE INVENTION

The present invention is adapted to be embodied in a marking pen comprising a sheath, a writing member having a front portion of relatively small diameter and a rear portion of relatively large diameter and a projecting means provided in the rear end portion of the sheath for moving the writing member between a writing position and a retracted non-writing position. The present invention comprises a fixed pressing protrusion provided within the front portion of the sheath, a spring member placed between the pressing protrusion and the large diameter portion of the writing member so as to push the writing member rearward, an elastic cylinder enclosing part of the small diameter portion of the writing member, an elastic pressing member adapted to allow the elastic cylinder to open when the writing member is positioned at the writing position and to close the elastic cylinder when the writing member is retracted, an elastic sealing member attached to the base end of the elastic pressing member, a sliding member fitted slidably on the small diameter portion of the writing member and a rib fixed to the small diameter portion of the writing member, wherein when the projecting means is operated to retract the writing member to the retracted position, the rib is brought into contact with the sealing member and is caused to push the sliding member rearward and the pressing member comes into engagement with the pressing protrusion provided on the sheath and is moved inward to press the elastic cylinder from the opposite sides so that the elastic cylinder is closed as the writing member is retracted to the retracted position thus storing the writing head of the writing member within a sealed space formed between the closed end of the elastic cylinder and the junction of the sealing member attached to the base end of the elastic pressing member and the rib, and when the projecting means is operated to project the writing member to the writing position, the rib and the sliding member, and the protrusion provided on the sheath and the pressing member are disengaged respectively, and thereby the elastic cylinder is released and allowed to open as the writing member is moved forward, whereby the writing head of the writing member is allowed to move through the elastic cylinder and to project from the open front end of the sheath.

BRIEF DESCRIPTION OF THE DRAWINGS

A preferred embodiment of the retractable capless marking pen according to the present invention will be described in detail hereinafter in connection with the accompanying drawings, in which.

DESCRIPTION OF THE PREFERRED EMBODIMENT

Writing member projecting and retracting mechanisms of various types are employed in various writing means, such as ball-point pens. Since a writing member projecting and retracting mechanism of any type may be used for the retractable capless marking pen of the present invention, the description thereof will be omitted.

Figure 1:
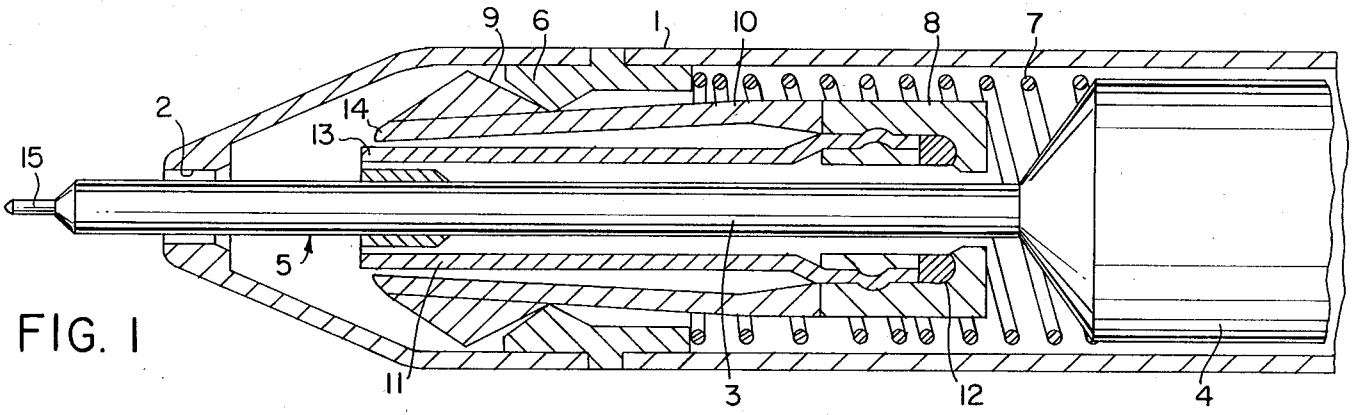
FIG. 1 is a longitudinal sectional view of a retractable capless marking pen embodying the present invention, in which the writing member is set at the writing position.
Figure 2:
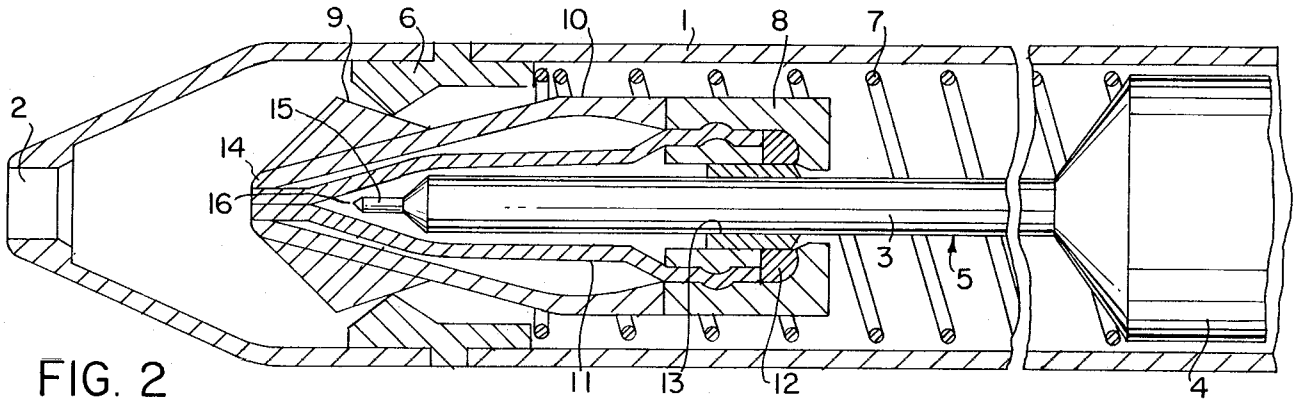
FIG. 2 is a partial longitudinal sectional view of the retractable capless marking pen of FIG. 1, in which the writing member is retracted and stored hermetically.

FIG. 1 shows a retractable capless marking pen embodying the present invention, in which the writing member is at the writing position, whereas, in FIG. 2, the same writing member is at the retracted position. A sheath 1 has an opening 2 at the front end thereof. A writing member 5 having a small diameter front portion 3 and a large diameter rear portion 4 is received in the sheath 1. A spring 7 is placed between a pressing protrusion 6 formed inside the front end portion of the sheath 1 and the thick portion 4 of the writing member 5 so as to push the writing member 5 rearward.

A sliding member 8 is fitted slidably on the thin portion 3 of the writing member 5. The sliding member 8 is provided with a pressing member 10 having a slanting surface 9 which engages the protrusion 6. An elastic cylinder 11, for example, a rubber cylinder, covering part of the thin portion 3 and an elastic sealing member 12 are attached to the root of the pressing member 10. A rib 13 is attached to the small diameter portion 3. The function of the rib 13 will be described afterward.

The manner of functions of the retractable capless marking pen of the present invention will be described hereinafter in connection with FIG. 1 (writing position) and FIG. 2 (retracted non-writing position).

In retracting the writing member 5 to the retracted position by operating the writing member projecting and retracting mechanism, not shown, first the writing member 5 starts being moved rearward relatively to the sheath 1 by the action of the spring 7, and thereby the rib 13 attached to the thin portion 3 is brought into contact with the sealing member 12. As the writing member 5 is moved further rearward, the rib 13 pushes the sliding member 8 rearward, which causes the slanting surface 9 of the pressing member 10 to engage the protrusion 6. As the pressing member 10 is moved rearward further, the extremity 14 of the pressing member 10 is moved radially inward of the sheath 1 until finally the extremity 14 of the pressing member 10 squeezes the open end of the elastic cylinder 11 completely so that the elastic cylinder 11 is closed. The writing head 15 of the writing member 5 has already been retracted, before the open end of the elastic cylinder 11 is closed, into a sealed space 16 formed between the closed end of the elastic cylinder 11 and the sealing junction of the rib 13 and the sealing member 12. Consequently, the evaporation or the volatilization of the ink from the writing head 15 is prevented.

In moving the writing member 5 to the writing position by operating the writing member projecting and retracting mechanism, first the writing member 5 starts being moved forward compressing the spring 7. Then, the the rib 13 attached to the thin portion 3 disengages the sealing member 12 joined to the sliding member 8 and at the same time the slanting surface 9 of the pressing member 10 disengages the protrusion 6, and thereby the the extremity 14 of pressing member 10 is allowed to move radially outward of the sheath 1 by the agency of its own elasticity releasing the open end of the elastic cylinder 11 so that the elastic cylinder 11 is allowed to open. The writing head 15 of the writing member 5 advances through the open end of the elastic cylinder 11 and projects from the open front end 2 of the sheath for writing.

It is apparent from what has been described hereinbefore that the retractable capless marking pen of the present invention using an oil ink or an aqueous ink incorporates a simple mechanism capable of moving the writing head between the writing position and the retracted position through the operation of the writing head projecting and retracting mechanism and this requires no separate cap, which is extremely advantageous and facilitates the use thereof.

What is claimed is:

1. A knock-type writing instrument comprising:

(a) a sheath having a back end and a front end;

(b) a writing member slidably accommodated in said sheath and having a front portion of relatively small diameter and a rear portion of relatively large diameter;

(c) actuating means on said sheath back end for actuating said writing member between a writing position and a non-writing position;

(d) protrusion means mounted within said sheath in the front end thereof;

(e) an elastic cylinder having an annular opening and covering a part of said writing member;

(f) an elastic pressing member surrounding said elastic cylinder; and (g) means on said elastic pressing member interacting with said protrusion means and operative to contact said pressing member about said elastic cylinder when said writing member is actuated to said non-writing position to thereby seal said pressing member about said elastic cylinder and to close said annular opening to thereby seal said elastic cylinder about said writing member.

2. A knock-type writing instrument comprising:

(a) a sheath having a back end and a front end;

(b) a writing member slidably accommodated in said sheath and having a front portion of relatively small diameter and a rear portion of relatively large diameter;

(c) actuating means on said sheath back end for actuating said writing member between a writing position and a non-writing position;

(d) protrusion means mounted within said sheath in the front end thereof;

(e) an elastic cylinder having an annular opening and covering a part of said relatively small diameter portion of said writing member;

(f) an elastic pressing member surrounding said elastic cylinder; and (g) a slanting surface on the periphery of said elastic pressing member and engageable with said protrusion means, engagement of said slanting surface with said protrusion means causing said elastic pressing member to contract about said elastic cylinder to thereby close said annular opening and seal said elastic cylinder about said writing member, and disengagement of said slanting surface from said protrusion means allowing said elastic pressing member to expand, thereby opening said annular opening and elastic cylinder and allowing said writing member to slide to said writing position.

* * * * *